US011646005B2

(12) United States Patent
Ohta

(10) Patent No.: US 11,646,005 B2
(45) Date of Patent: May 9, 2023

(54) CONTENT CONTROL DEVICE, METHOD OF CONTROLLING CONTENT AND NON-TRANSITORY COMPUTER-READABLE STORAGE MEDIUM

(71) Applicant: YAMAHA CORPORATION, Hamamatsu (JP)

(72) Inventor: Shinichi Ohta, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 195 days.

(21) Appl. No.: 17/000,433

(22) Filed: Aug. 24, 2020

(65) Prior Publication Data

US 2021/0090533 A1 Mar. 25, 2021

(30) Foreign Application Priority Data

Sep. 19, 2019 (JP) ..... JP2019-170308

(51) Int. Cl.
*G10H 1/00* (2006.01)

(52) U.S. Cl.
CPC ..... *G10H 1/0008* (2013.01)

(58) Field of Classification Search
CPC ..... G10H 1/0008
USPC ..... 84/602
See application file for complete search history.

(56) References Cited

U.S. PATENT DOCUMENTS 7,548,791 B1 * 6/2009 Johnston ..... G10H 1/0008 381/56
2006/0182418 A1 * 8/2006 Yamagata ..... G11B 27/105 386/290
2007/0047913 A1 * 3/2007 Kagawa ..... H04N 5/783 386/E5.052
2008/0002549 A1 * 1/2008 Copperwhite ..... G10G 1/00 84/602
2011/0142426 A1 * 6/2011 Sasaki ..... G11B 20/1251 386/337
2017/0221464 A1 * 8/2017 Ohta ..... H04N 5/262
2019/0103080 A1 * 4/2019 Decker ..... G10H 1/40
(Continued)

FOREIGN PATENT DOCUMENTS

DE 102021202105 A1 * 9/2021 ..... G10H 1/346
JP 2008158434 A * 7/2008
(Continued)

*Primary Examiner* — Christina M Schreiber
(74) *Attorney, Agent, or Firm* — Rossi, Kimms & McDowell LLP

(57) ABSTRACT

According to an exemplary embodiment, a content control device for a content divided into multiple playback sections includes at least one memory storing executable instructions and a processor that implements the executable instructions to execute a plurality of tasks. The plurality of tasks include a selecting task, a first acquiring task and an outputting task. The selecting task selects a playback section among the multiple playback sections. The first acquiring task acquires a first operation value in response to an operation of a first operation unit. The outputting task that outputs a plurality of parameter values. The plurality of parameter values are used for varying the content in the selected playback section, corresponding to the acquired first operation value based on control data that defines a relationship between the first operation value and the plurality of parameter values.

20 Claims, 8 Drawing Sheets

(56) References Cited

U.S. PATENT DOCUMENTS

| | | | | |
|---|---|---|---|---|
| 2021/0090533 | A1* | 3/2021 | Ohta | G10H 1/055 |
| 2021/0287644 | A1* | 9/2021 | Saito | G10H 1/46 |
| 2022/0258748 | A1* | 8/2022 | Vedantam | H04W 84/18 |

FOREIGN PATENT DOCUMENTS

| | | | | | |
|---|---|---|---|---|---|
| JP | 2016081043 | A | | 5/2016 | |
| JP | 2016081043 | A | * | 5/2016 | G06F 3/011 |
| JP | 2016081044 | A | * | 5/2016 | G06F 3/011 |
| JP | 2016081044 | A | | 5/2016 | |
| JP | 2016081045 | A | * | 5/2016 | G06F 3/011 |
| JP | 2016081045 | A | | 5/2016 | |
| JP | 2017129604 | A | | 7/2017 | |
| JP | 2017129604 | A | * | 7/2017 | |
| JP | 2017129611 | A | * | 7/2017 | |
| JP | 2021047314 | A | * | 3/2021 | G10H 1/0008 |
| WO | WO-2016060211 | A | * | 4/2016 | G06F 3/011 |

* cited by examiner

| Parameter | Operation Value SV | Conversion Data |
|---|---|---|
| PM1 | SaV | CD1 |
| PM2 | SbV | CD2 |
| PM3 | ScV | CD3 |
| PM4 | — | — |
| PM5 | SdV | CD4 |
| ⋮ | ⋮ | ⋮ |

CONTENT CONTROL DEVICE, METHOD OF CONTROLLING CONTENT AND NON-TRANSITORY COMPUTER-READABLE STORAGE MEDIUM

CROSS-REFERENCE TO RELATED APPLICATIONS

This application is based upon and claims the benefit of priority from the prior Japanese Patent Application No. 2019-170308, filed on Sep. 19, 2019, the entire contents of which are incorporated herein by reference.

FIELD

The present disclosure relates to techniques for controlling a content.

BACKGROUND

An electronic musical instrument outputs sounds based on the various parameters. These parameters include the parameters that can be varied in real time by a controller provided in the electronic musical instrument. Various performances can be expressed by varying the parameters in real time. Generally, a single parameter is assigned to a single controller. That is, when a plurality of parameters are to be varied simultaneously, a plurality of controllers must be operated. Therefore, a technique for simultaneously operating multiple controllers by operating on a single controller has been developed (Patent Documents: Japanese Laid-Open Patent Application Publication No. 2017-129604, Japanese Laid-Open Patent Application Publication No. 2016-81043, Japanese Laid-Open Patent Application Publication No. 2016-81044, Japanese Laid-Open Patent Application Publication No. 2016-81045).

SUMMARY

According to an exemplary embodiment of the present disclosure, there is provided a content control device for a content divided into multiple playback sections, the content control device including: at least one memory storing executable instructions; and a processor that implements the executable instructions to execute a plurality of tasks, including: a selecting task that selects a playback section among the multiple playback sections; a first acquiring task that acquires a first operation value in response to an operation of a first operation unit; and an outputting task that outputs a plurality of parameter values, which are used for varying the content in the selected playback section, corresponding to the acquired first operation value based on control data that defines a relationship between the first operation value and the plurality of parameter values.

According to an exemplary embodiment of the present disclosure, there is provided a method of controlling a content divided into multiple playback sections, the method including: selecting a playback section among the multiple playback sections; acquiring a first operation value in response to an operation of a first operation unit; and outputting a plurality of parameter values, which are used for varying the content in the selected playback section, corresponding to the acquired first operation value based on control data that defines a relationship between the first operation value and the plurality of parameter values.

According to an exemplary embodiment of the present disclosure, there is provided a non-transitory computer-readable storage medium storing a program executable by a computer to execute a method of controlling a content divided into multiple playback sections, the method including: selecting a playback section among the multiple playback sections; acquiring a first operation value in response to an operation of a first operation unit; and outputting a plurality of parameter values, which are used for varying the content in the selected playback section, corresponding to the acquired first operation value based on control data that defines a relationship between the first operation value and the plurality of parameter values.

DESCRIPTION OF EMBODIMENTS

Figure 1:
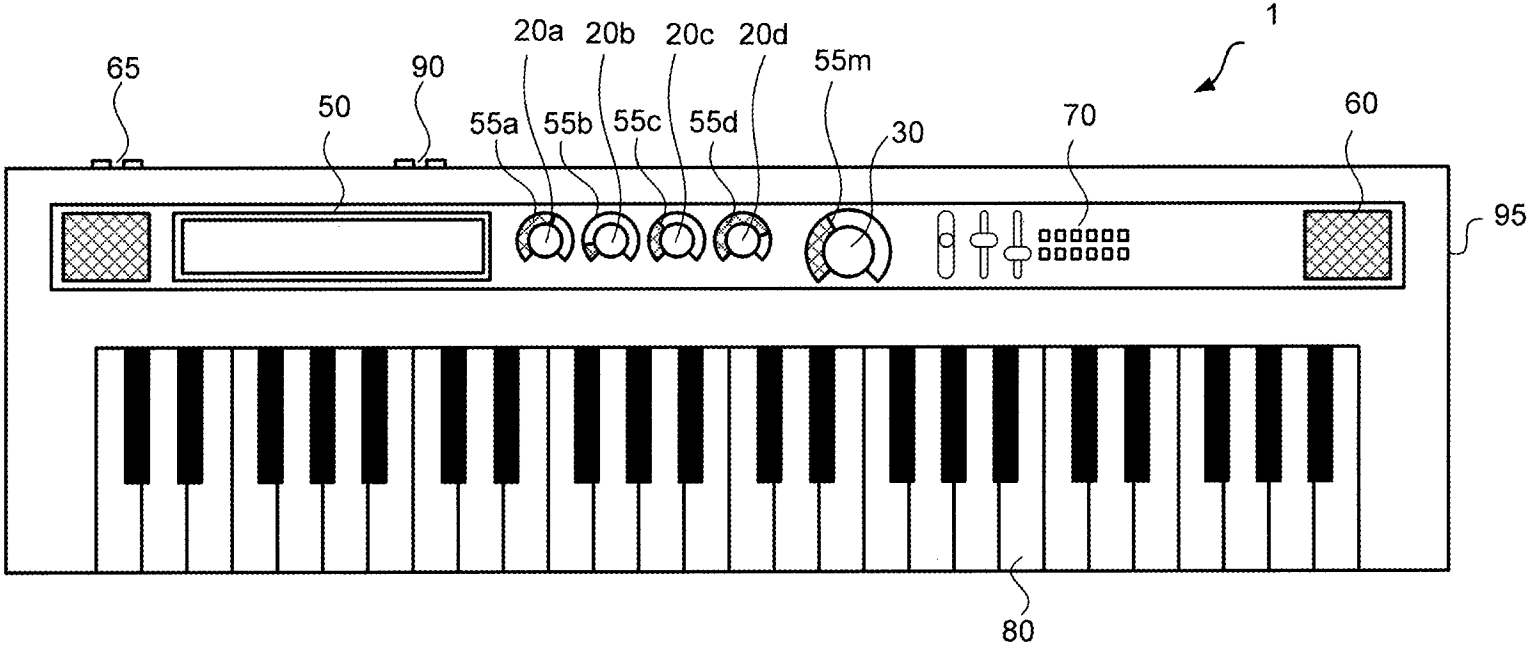
FIG. 1 is a diagram for illustrating an external appearance of an electronic keyboard device according to a first embodiment of the present disclosure.

Hereinafter, an electronic keyboard device according to exemplary embodiments of the present disclosure will be described in detail with reference to the drawings. The following embodiments are examples of embodiments of the present disclosure, and the present disclosure is not construed within the limitations of these exemplary embodiments. In the drawings referred to in the present exemplary embodiments, the same portions or portions having similar functions are denoted by the identical signs or similar signs (signs each formed simply by adding A, B, etc. to the end of a number), and a repetitive description thereof may be omitted. For convenience of description, the dimensional ratio of the drawings may be different from the actual ratio, or a part of the configuration may be omitted from the drawings.

First Embodiment

[1. Configuration of Electronic Keyboard Device]

FIG. 1 is a diagram illustrating an external view of an electronic keyboard device according to a first embodiment of the present disclosure. The electronic keyboard device 1 is, for example, a synthesizer with a keyboard unit 80. The keyboard unit 80 contains a plurality of keys. The electronic keyboard device 1 generates an audio signal by the user operating a key or instructing a sequencer to play back music data.

The audio signal is output from a signal output unit 65. The audio signal may be output from a speaker 60 depending on the setting. In this example, by operating a plurality of setting knobs 20*a*, 20*b*, 20*c*, 20*d*, the electronic keyboard device 1 varies the plurality of parameter values used in generating the audio signal to vary the sound. If each of setting knobs 20*a*, 20*b*, 20*c*, 20*d* does not need to be described separately, it may simply be described as the setting knob 20.

Further, when a master knob 30 is operated, the electronic keyboard device 1 reproduces the same situation as when a plurality of the setting knobs 20*s* are operated simultaneously on the basis of preset control data. The electronic keyboard device 1 can use different control data depending on a playback section of a musical piece, which will be described in detail later. Thus, even though the same operation is taken on the master knob 30 in different playback sections, the electronic keyboard device 1 can make the tonal changing aspect differ depending on the playback section being played back.

The indicated position display units 55*a*, 55*b*, 55*c*, 55*d*, 55*m* are disposed around the setting knobs 20*a*, 20*b*, 20*c*, 20*d* and the master knob 30, respectively. The indicated position display units 55*a*, 55*b*, 55*c*, 55*d* and 55*m* display the indicated positions of the setting knobs 20*a*, 20*b*, 20*c*, 20*d* and the master knob 30, respectively. A collective structure of the indicated position display units 55 *a*, 55*b*, 55*c*, 55*d* and 55*m* may be described as the indicated position display unit 55.

According to the four patent documents described above, a user can express various performances by the operation to a single controller. In order to realize such a performance expression, it is necessary to set a control manner of a plurality of parameters in advance. It is not easy to set the control manner in real time during the musical performance. On the other hand, in the electronic keyboard device 1, it is possible to easily vary the control manner of a plurality of parameters corresponding to operations on the single controller in accordance with the progress of a musical piece. Hereinafter, the configuration of the electronic keyboard device 1 will be described in detail with reference to FIG. 2.

Figure 2:
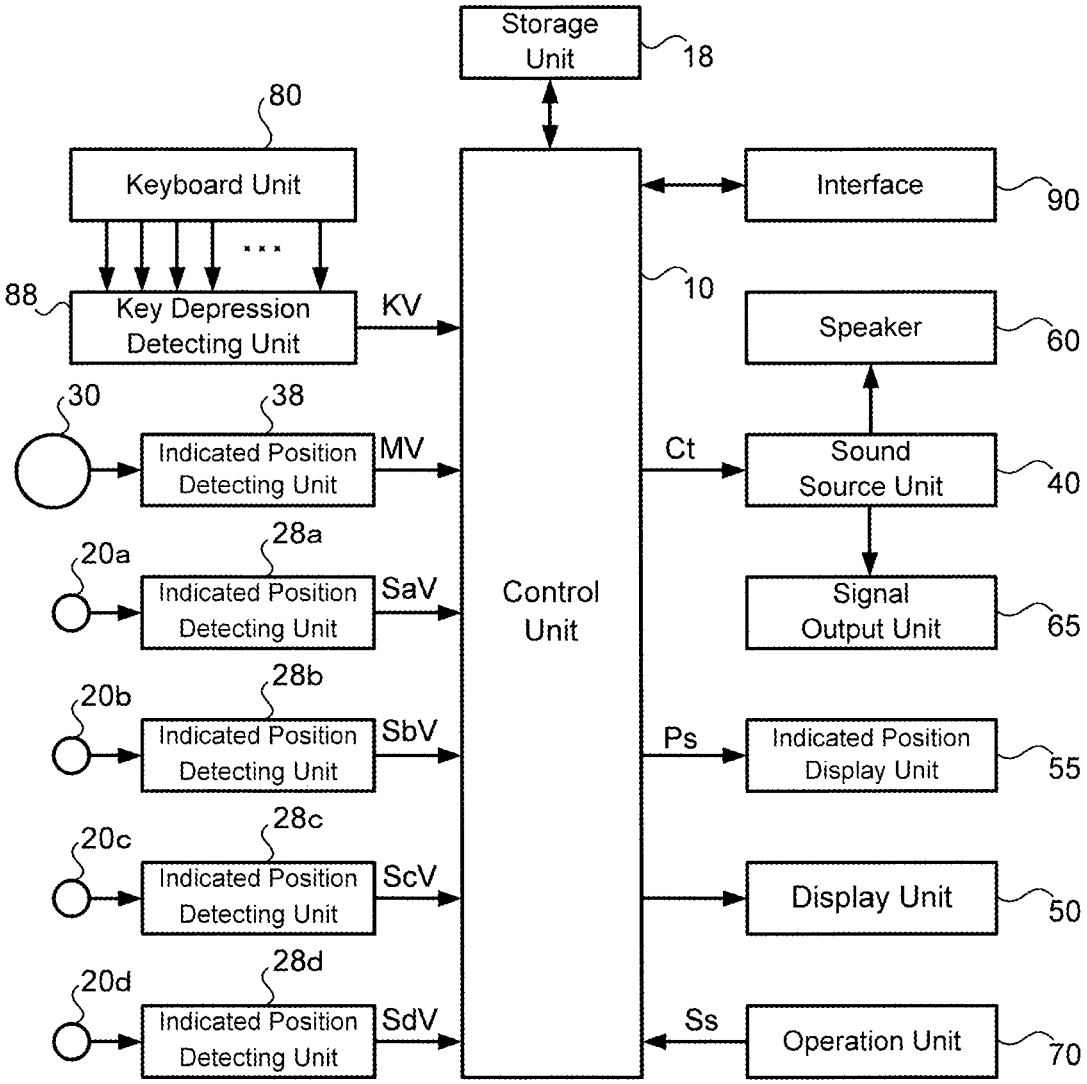
FIG. 2 is a diagram for illustrating the configuration of the electronic keyboard device in the first embodiment of the present disclosure.

FIG. 2 is a diagram for illustrating the configuration of the electronic keyboard device in the first embodiment of the present disclosure. The electronic keyboard device 1 includes a control unit 10, a storage unit 18, a plurality of setting knobs 20, a master knob 30, a sound source unit 40, a display unit 50, a indicated position display unit 55, a speaker 60, a signal output unit 65, an operation unit 70, a keyboard unit 80, and an interface 90. The electronic keyboard device 1 includes a plurality of sensors. In this example, the plurality of sensors includes the indicated position detecting units 28*a*, 28*b*, 28*c*, 28*d*, 38, and the key depression detecting unit 88.

The control unit 10 is an example of a computer that includes a calculation processing circuitry (processor), such as a CPU, and the memory device, such as a RAM and a ROM. The control unit 10 executes the control program stored in the storage unit 18 by the CPU to realize various functions in the electronic keyboard device 1 by instructions written in the program. The various functions include a sound control function 100 (see FIG. 6) described below. The programs may be provided from an external device and installed in the storage unit 18.

The keyboard unit 80 includes a plurality of keys rotatably supported on a housing 95. The key depression detecting unit 88 outputs a detected signal KV to the control unit 10. The detected signal KV indicates the depressed key and the depressed amount of the depressed key. The operation unit 70 is a device such as an operator button, a touch sensor and a slider, and accepts the user's instructions for the electronic keyboard device 1. The operation unit 70 outputs the operating signals corresponding to the user's instructions to the control unit 10. The operation unit 70 includes an operator for selecting a musical piece to be played back and an operator (the section operation unit) for selecting a playback section of the musical piece to be played back. In particular, the operator for selecting a playback section to be played back may include buttons corresponding to each of a plurality of playback sections. With these buttons, the user can select a playback section to be played back and enter an instruction to switch the playback section to be played back into the electronic keyboard device 1 by single operation. When a musical piece to be played back is selected by the operation unit 70, a selection signal Sm indicating that the musical piece is output to the control unit 10. When the playback section to be played back by the operating unit 70 is selected, a selection signal Ss indicating the playback section is output to the control unit 10.

The display unit 50 includes a display device such as a liquid crystal display and displays various screens under the control of the control unit 10. In this example, the interface 90 includes a terminal for connecting external devices, such as controllers, to the electronic keyboard device 1. The interface 90 may include a terminal for sending and receiving MIDI data.

The sound source unit 40 generates an audio signal based on the sound source control signal Ct output from the control unit 10. The generated audio signal may be supplied to the signal output unit 65 and further supplied to the speaker 60. Whether or not the audio signal is output to the speaker 60 may be determined depending on the setting. The sound source control signal Ct includes the information required to generate the audio signal, and may include, for example, information for controlling the generation of each sound such as note number, note on, note off, or the information for controlling effects such as reverb, chorus, phaser, wah, and the like. The information is determined for each channel corresponding to the performance part. The sound source unit 40 may be implemented in hardware, such as a DSP, or may be implemented in software. When implemented by software, the CPU may execute a program stored in the memory to realize the functions of the sound source unit 40. Some of the functions of the sound source unit 40 may be realized by software and the rest by hardware.

The signal output unit 65 includes a terminal for the audio signal supplied from the sound source unit 40 output to an external device. The speaker 60 amplifies and outputs the audio signal supplied from the control unit 10 or the sound source unit 40, thereby generating sound corresponding to the audio signal.

The setting knob 20 (a second operation unit) and master knob 30 (a first operation unit) are rotary encoders in this example. The setting knob 20 and the master knob 30 differ from each other in appearance. In this example, the diameter and height of the master knob 30 are greater than the diameter and height of the setting knob 20. In this example, the plurality of setting knobs 20 have the same shape. At least one of setting knobs 20 may be shaped differently than the other setting knob 20.

The indicated position detecting unit 28*a* detects the indicated position of the setting knob 20*a*, and outputs the operation value SaV corresponding to the indicated position to the control unit 10. The operation value SaV may include the information (for example, integers from "0" to "127")

that directly indicates the indicated position of the setting knob 20*a* itself. The operation values SaV may include the information indicating an operation amount to the setting knob 20*a* (a variation amount of the indicated position), i.e., the information relatively indicating the indicated position. In the following description, the operation value SaV is the information directly indicating the indicated position.

Similarly, the indicated position detecting units 28*b*, 28*c*, 28*d* detect the indicated positions of the setting knobs 20*b*, 20*c*, 20*d*, and outputs the operation values SbV, ScV, SdV corresponding to the indicated positions to the control unit 10, respectively. When it is not necessary to explain the operation values SaV, SbV, ScV, and SdV separately, the operation values may be simply described as the operation value SV (the second operation value).

The Indicated position detecting unit 38 detects the indicated position of the master knob 30 and outputs the operation value MV (first operation value) corresponding to the indicated position to the control unit 10. The operation value MV may include information directly indicating the pointing position of the master knob 30 itself, in this example, integers from 0 to 127. The operation values MV may include the information indicating the operation amount to the master knob 30, i.e., the information relatively indicating an indicated position. In the following description, the operation value MV is the information directly indicating the indicated position.

The Indicated position display unit 55*a* is a light-emitting element disposed along the outer periphery of the setting knob 20*a* and shows the indicated position of the setting knob 20*a* (position corresponding to the operation value SaV) by light emission. The relationship, respectively, between the indicated position display units 55*b*, 55*c*, 55*d* and the setting knobs 20*b*, 20*c*, 20*d* is also the same as the relationship between the indicated position display units 55*a* and the setting knob 20*a*. The indicated position display unit 55*m* is a light-emitting element arranged along the outer periphery of the master knob 30 and shows the indicated position of the master knob 30 (position corresponding to the operation value MV) by the light emission. The indicated position display units 55 (55*a*, 55*b*, 55*c*, 55*d*, 55*m*) displays the indicated position of the corresponding knob (the setting knobs 20*a*, 20*b*, 20*c*, 20*d* and the master knob 30) on the basis of the light emission control signal Ps output from the control unit 10, respectively. At this time, the control unit 10 calculates the indicated position of the setting knob 20 and the master knob 30 on the basis of the indicated position included in the operation value SV and the operation value MV, and outputs the light emission control signal Ps based on the calculation result.

The storage unit 18 is a memory device such as a non-volatile memory, and includes a region for storing control programs executed by the control unit 10 and a region for storing parameters for use in controlling the sound source unit 40. These parameters include a music data set (see FIG. 3) and a setting data set (see FIG. 4). The music data set is stored in a music data storage area 185 (see FIG. 6). The setting data set is stored in a setting data storage area 181 (see FIG. 6). The music data set and the setting data set can be edited or newly created according to the users instructions. The music data set and the setting data set will be described in detail with reference to FIGS. 3 and 4.

Figure 3:
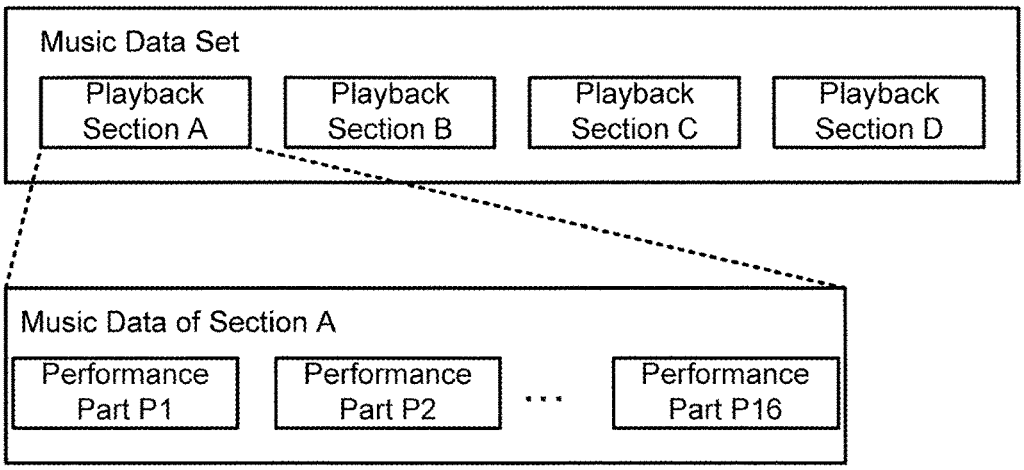
FIG. 3 is a diagram illustrating a music data set in the first embodiment of the present disclosure.

FIG. 3 is a diagram for illustrating the music data set in the first embodiment of the present disclosure. The music data set is data obtained by combining a plurality of pieces of the music data. The musical piece corresponding to the music data set is divided into multiple playback sections. The multiple playback sections are sections corresponding to the composition of the musical piece, and correspond to, for example, an introduction section, a melody section, a chorus section (sabi), an interlude section, an ending section, and the like. In the example shown in FIG. 3, the musical piece is divided into four playback sections (playback section A, playback section B, playback section C, playback section D). Each of the plurality of pieces of the music data that constitutes the music data set is set to correspond to one of the multiple playback sections. In this example, the music data defines the sound generating manner of each of the plurality of the performance parts according to a predetermined standard such as the MIDI. In the music data of playback section A shown in FIG. 3, a plurality of the performance parts correspond to the performance parts P1 to P16 of 16 channels.

Single musical piece is constituted by playing back the music data corresponding to the playback section A to the playback section D in order. The length of the playback section, for example, the number of bars, is defined, and when the music data is played back at the end of the playback section, the music data is played back by returning to the beginning of the playback section. For example, when the music data of the playback section A is played back, the music data of the playback section A is repeatedly played back until the playback section to be played back is switched to another playback section by the user. Even if the playback section to be played back may not be switched to another playback section by the user, the playback section to be played back may be automatically switched to the next playback section when a predetermined condition is satisfied. For example, the predetermined condition may be a preset number of repetitions. The number of repetitions may be set to 0 (no repetition). In this case, the number of repetitions may be set corresponding to each piece of the music data. As described above, the user can select the playback section to be played back. Therefore, depending on the selection order, a single musical piece may be constituted without using a least one of the playback sections according to the user's intention. For example, when the user select in order such as playback section A, playback section C, playback section B, and playback section A, the musical piece may be constructed without using playback section D, and with the order of the playback sections to be played back interchangeably.

Figure 4:
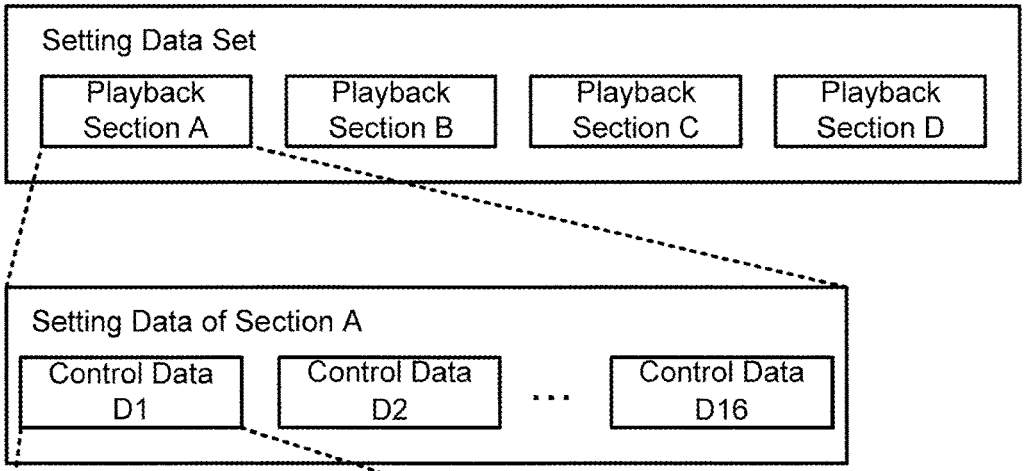
FIG. 4 is a diagram for illustrating a setting data set in the first embodiment of the present disclosure.

FIG. 4 is a diagram illustrating a setting data set in a first embodiment of the present disclosure. The setting data set is the data corresponding to the music data set and, the setting data set is a collection of the setting data determined in accordance with the above-mentioned playback sections.

The configuration data includes the control data D1 to D16 corresponding to the performance parts P1 to P16 of the above 16 channels, respectively. Each of the control data associates the operation values SaV, SbV, ScV, and SdV (also referred to as the setting knobs 20*a*, 20*b*, 20*c*, 20*d*) with the parameter PM (PM1, PM2, PM3, PM4, PM5, . . . ), and in addition, with the conversion data CD (CD1, CD2, CD3, CD4, . . . ). The parameter PM is used to vary the sound of the playback of the music data. The operation values SaV, SbV, ScV and SdV are used to control the values of the parameters. The conversion data CD are used when controlling parameters by the master knob 30. In the example shown in FIG. 4, the setting data define that, for example, the operation value SaV corresponds to the parameter value PV in the parameter PM1. Therefore, the parameter value PV and the operation value SaV have a predetermined relation, for example, the same value as each other. The conversion data CD defines the relation between the operation value MV and the parameter values PV when the master knob 30 is operated. As shown in FIG. 4, there may be a parameter PM (PM4 in this case) with which the operation value SV and the conversion data CD are not associated, or the same operation value SV may be associated with each of a plurality of parameters PM.

The conversion data CD is not limited to data in which the relationship between the operation value MV and the parameter values PV is defined, and the conversion data CD may be the data in which the relationship between the operation value MV and the operation values SV is defined. Since the operation value SV and the parameter value PV have a predetermined relationship, even if the conversion data CD define the relationship between the operation value MV and the operation values SV, the relationship between the operation value MV and the parameter values PV is indirectly defined.

Figure 5:
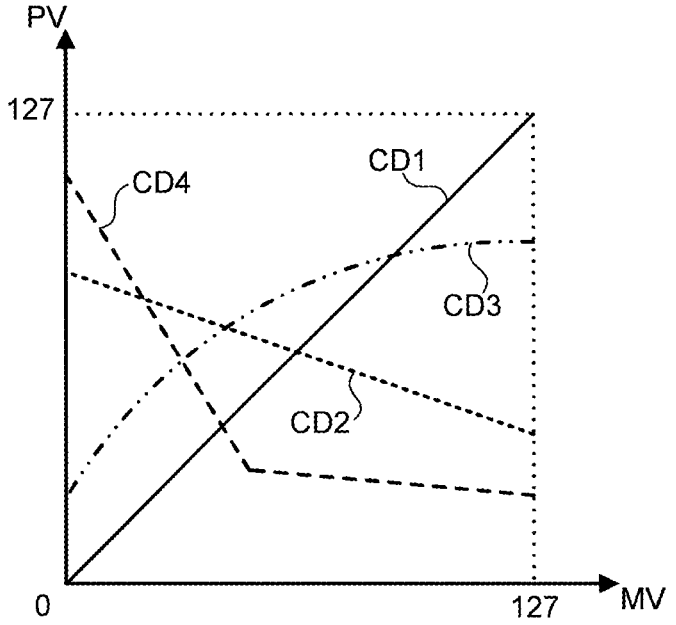
FIG. 5 is a diagram for illustrating conversion data in the first embodiment of the present disclosure.

FIG. 5 is a diagram for illustrating the conversion data in the first embodiment of the present disclosure. The operation value MV and the parameter values PV can be defined in various relationships. In this example, the relationship between the operation value MV and the parameter values PV is illustrated by four conversion data CD1, CD2, CD3, CD4. The conversion data CD1 is an example in which the parameter value PV becomes larger as the operation value MV becomes larger, and the slope of the relationship is "1". As a result, the operation value MV and the parameter value PV have the same value. In the conversion data CD2, the parameter value PV becomes smaller as the operation value MV becomes larger, and the absolute value of the slope is smaller than "1". Since the slope is smaller than "1", the variation amount in the parameter value PV is smaller than the variation amount in the operation value MV. The conversion data CD3 is an example in which the parameter value PV increases as the operation value MV increases, and the slope continuously varies according to the variation of the operation value MV. The conversion data CD4 is an example in which the parameter value PV becomes smaller as the operation value MV becomes larger, and the slope discontinuously varies according to the variation of the operation value MV.

For any of the conversion data CD, a relation is defined in which the parameter value PV increases as the operation value MV increases, or the parameter value PV decreases as the operation value MV increases. In addition to these examples, the conversion data CD can variously define the relationship between the minimum value and the maximum value of the parameter value PV corresponding to the minimum value and the maximum value of the operation value MV respectively, and the relationship between the variation of the parameter value PV and the variation of the operation value MV. The setting data set having such a configuration can define the control manner of the parameter based on the operation of the master knob 30, corresponding to the playback section of the musical piece.

[2. Configuration of Sound Control Function]

The sound control function 100 realized in the control unit 10 will be described with reference to FIG. 6.

Figure 6:
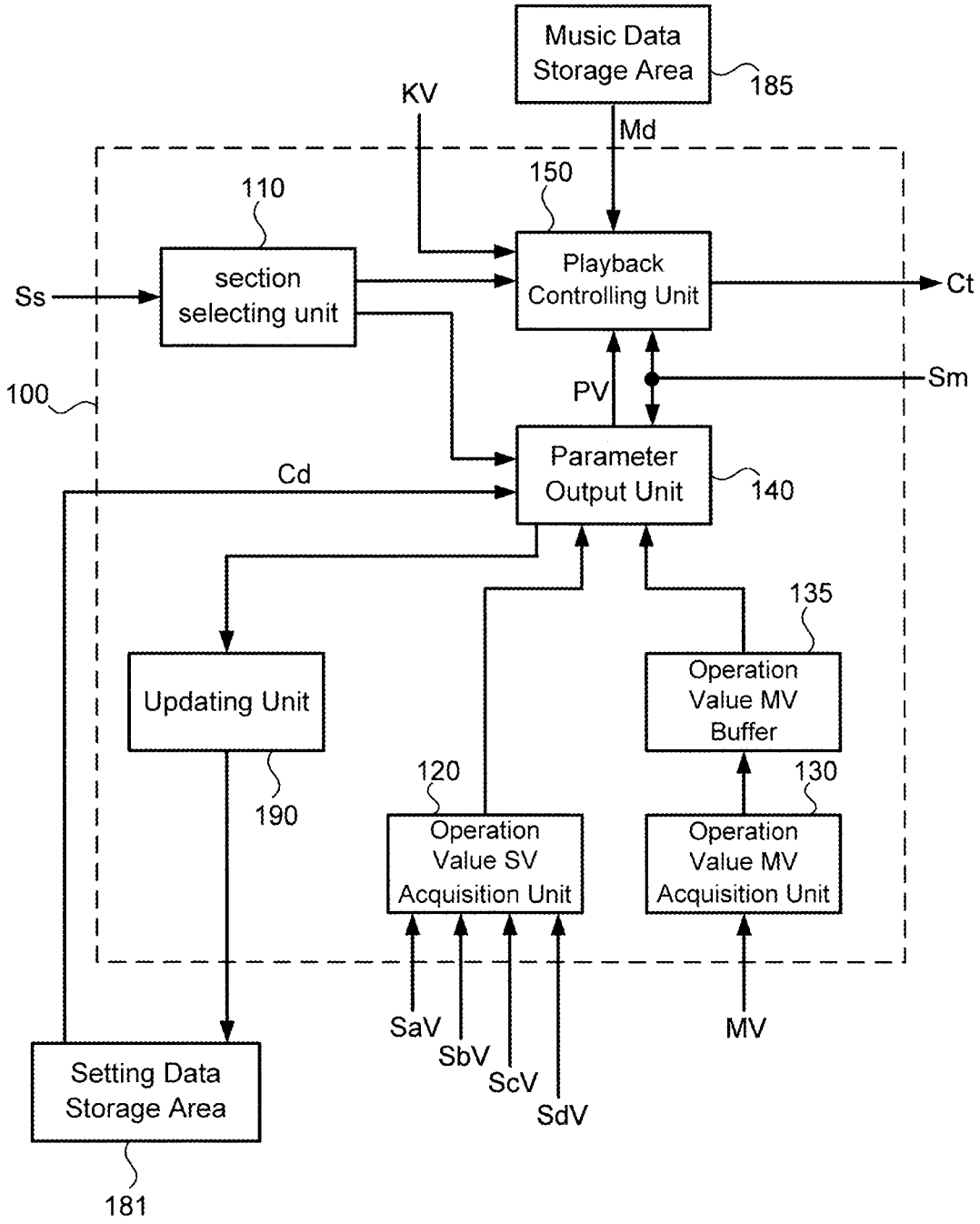
FIG. 6 is a diagram illustrating a sound control function in the first embodiment of the present disclosure.

FIG. 6 is a diagram for illustrating the sound control function in the first embodiment. When executing the control programs, the control unit 10 realizes the sound control function 100 in the electronic keyboard device 1. The configurations for realizing the sound control function 100 include: a section selecting unit 110, an operation value SV acquisition unit 120, an operation value MV acquisition unit 130, an operation value MV buffer 135, a parameter output unit 140, a playback controlling unit 150, and an updating unit 190. All of these configurations may be realized by software, or at least a part thereof may be realized by hardware.

When acquiring the operation signal Ss (a signal indicating the selected section of the musical piece), the section selecting unit 110 selects the section (the selected playback section) to be played back based on the operation signal Ss among the multiple playback sections to set the selected playback section to the parameter output unit 140 and the playback controlling unit 150. For example, the section selecting unit 110 sets the selected playback section to the parameter output unit 140 and playback the controlling unit 150 by outputting a signal specifying the selected playback section.

The operation value SV acquisition unit 120 (a second operation value acquisition unit) acquires the operation values SaV, SbV, ScV, and SdV and supplies them to the parameter output unit 140. Thus, the parameter output unit 140 can acquire the indicated position or the variation amount (operation amount) of the indicated position of each of the setting knob 20*a*, 20*b*, 20*c*, 20*d*.

The operation value MV acquisition unit 130 (a first operation value acquisition unit) acquires the operation value MV and supplies it to the parameter output unit 140. Thus, the parameter output unit 140 can acquire the indicated position or the variation amount (operation amount) of the indicated position of the master knob 30. The most recent operation value MV obtained in this manner are stored in the operation value MV buffer 135. The operation value MV buffer 135 stores the operation value MV last acquired by the operation value MV acquisition unit 130. Until the operation value MV acquisition unit 130 first acquires the operation value MV, the operation value MV buffer 135 stores an initial value (e.g., "0").

When acquiring the operation signal Sm, the parameter output unit 140 reads out the setting data set Cd corresponding to the musical piece (the music data set) to be played back from the setting data storage area 181 based on the operation signal Sm. The parameter output unit 140 reads out the setting data corresponding to the selected playback section by the section selecting unit 110 from the setting data set Cd. The parameter output unit 140 outputs a plurality of the parameter values PV corresponding to the respective performance part to the playback controlling unit 150 based on the control data included in the setting data read out.

According to the setting data shown in FIG. 4, for example, a plurality of parameter values based on control data D1 are output to performance part P1 (channel 1). The timing at which parameter value is output, the timing immediately after the selected playback section is changed, the timing at which the operation value MV is supplied from the operation value MV acquisition unit 130, and the timing at which any of the operation values SaV, SbV, ScV, and SdV is supplied from the operation value SV acquisition unit 120 are exemplified.

According to the setting data set shown in FIG. 4, when the operation value MV is supplied, the parameter output unit 140, for example, outputs the parameter value PV of each of the parameter PM1, PM2, PM3, PM5 associated with the operation values SaV, SbV, ScV, SdV to the performance part P1 based on the control data D1. The parameter values PV at this time are the values corresponding to the operation value MV, and are values converted based on the conversion data CD. For example, the parameter value PV of the parameter PM2 is a value obtained by converting the operation value MV based on the conversion data CD2. That is, as the operation value MV increases, the parameter value PV of the parameter PM2 decreases. In this way, it can be said that the control data defines the relationship between the operation value MV and a plurality of the parameter values PV in order to vary sounds of the selected playback section among the multiple playback sections.

On the other hand, when any of the operation values SaV, SbV, ScV SdV is supplied, for example, when the operation value SaV is supplied, the parameter output unit 140 outputs the parameter value PV of the parameter PM1 associated with the operation value SaV based on the control data. The parameter value PV at this time is a value modified corresponding to the variation amount of the operation value SaV, and in this example, the value varied by an amount corresponding to the variation amount of the operation value SaV from a reference value which is the value of the parameter value PV output last.

When the parameter PV is modified based on the operation value SV, the parameter output unit 140 modifies the relationship between the operation value MV stored in operation value MV buffer 135 and the modified parameter PV so as to be reflected in the control data included in the setting data read out. The part of the control data to be modified is the conversion data CD. The modified control data is output to the updating unit 190. Examples of control data modification methods are described below.

When the selected playback section is switched, as described above, the parameter output unit 140 reads out the setting data corresponding to the newly set playback section from the setting data set Cd, reads out the operation value MV from the operation value MV buffer 135, and outputs a plurality of parameter values PV to the playback controlling unit 150 based on the control data included in the setting data newly read out. As a result, the relationship between the operation value MV and the plurality of parameter value PVs differs depending on the selected playback section. That is, even though the same operation values MV are taken in different playback sections, the setting for outputting a plurality of parameter value PV different depending on the selected playback section can be easily realized.

When acquiring the operation signal Sm, the playback controlling unit 150 reads out the music data set Md of the musical piece to be played back based on the operation signal Sm, from the music data storage area 185. The playback controlling unit 150 reads out the music data corresponding to the selected playback section selected by the section selecting unit 110 from the music data set Md. The playback controlling unit 150 generates a sound source control signal Ct to supply it to the sound source unit 40. The sound source control signal Ct is a signal for the sound source unit 40 generating an audio signal corresponding to the music data read out. That is, the playback controlling unit 150 includes a function corresponding to a sequencer for controlling the sound source unit 40. At this time, the playback controlling unit 150 generates the sound source control signal Ct after correcting the music data by a plurality of parameter values PV (in this example, the value of the parameter PM1, PM2, PM3, PM4) acquired from the parameter output unit 140. Until the selected playback section selected by the section selecting unit 110 is switched to another playback section, the playback controlling unit 150 repeats the playback of the music data of the selected playback section by playing back the music data by returning to the beginning of the selected playback section when the music data is played back at the end of the selected playback section.

When acquiring the detection signal KV from the key depression detecting unit 88, the playback controlling unit 150 generates a sound source control signal Ct so that the sound source unit 40 also generate the audio signal to be generated based on the detection signal KV. This detected signal KV is output corresponding to the preset performance part (channel). Therefore, the playback controlling unit 150 outputs the sound source control signal Ct by the parameter value PV output from the parameter output unit 140 in accordance with the control data corresponding to the performance part, so as to also modify the audio signal based on the detection signal KV.

When acquiring the control data (the control data modified in the parameter output unit 140) from the parameter output unit 140, the updating unit 190 sequentially updates the control data included in the setting data set of the setting data storage area 181. This updating may be performed by the operation of the operation unit 70 (the update instructions by the user). The updating unit 190 may perform this update by occurring the instruction of selecting a new playback section (acquisition of the operation value Ss). The sound control function 100 has been described above.

[3. Processing of Sound Control Method]

The process flow in the sound control function 100 will be described with reference to FIGS. 7 and 8.

Figure 7:
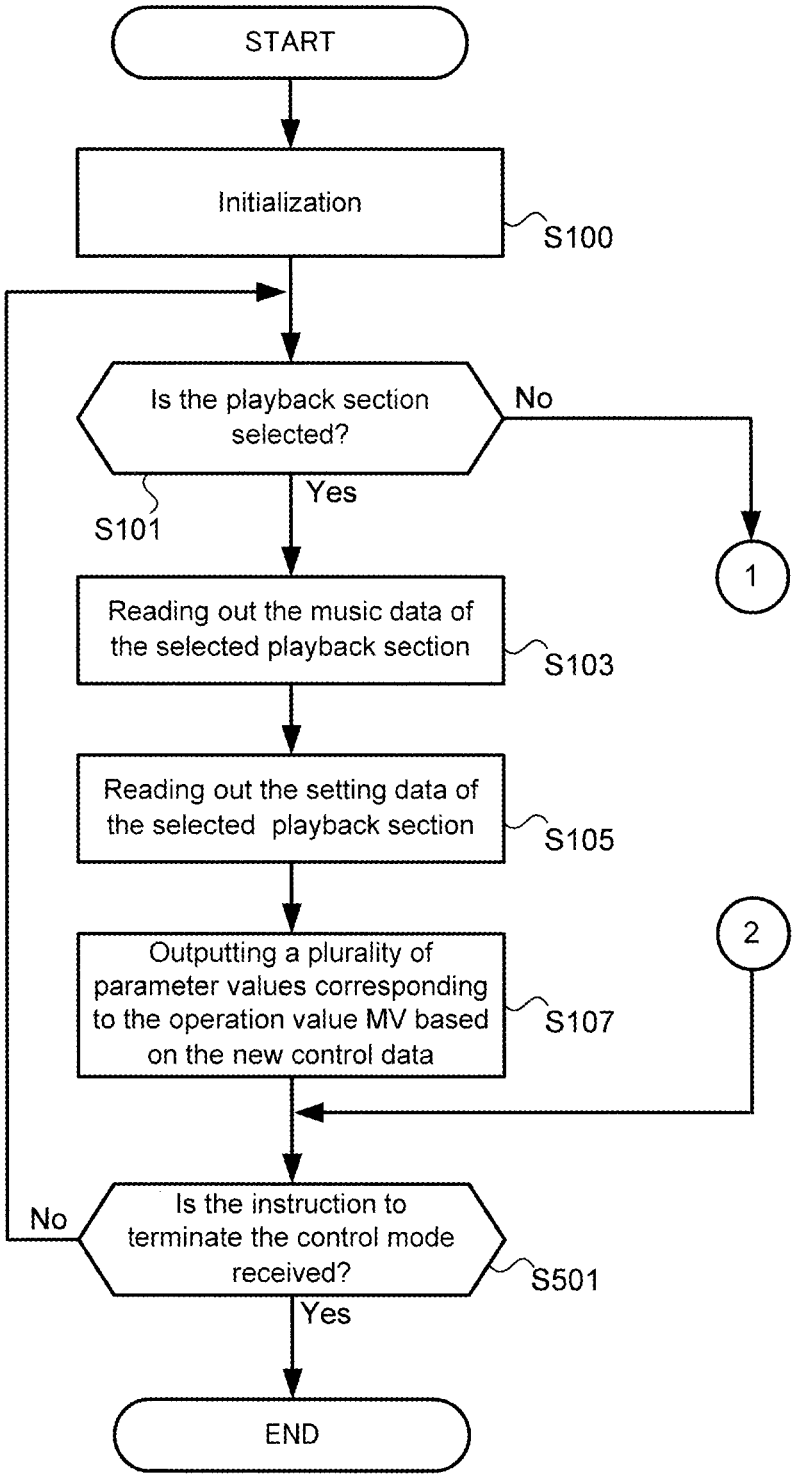
FIG. 7 is a flowchart illustrating a sound control method according to the first embodiment of the present disclosure.
Figure 8:
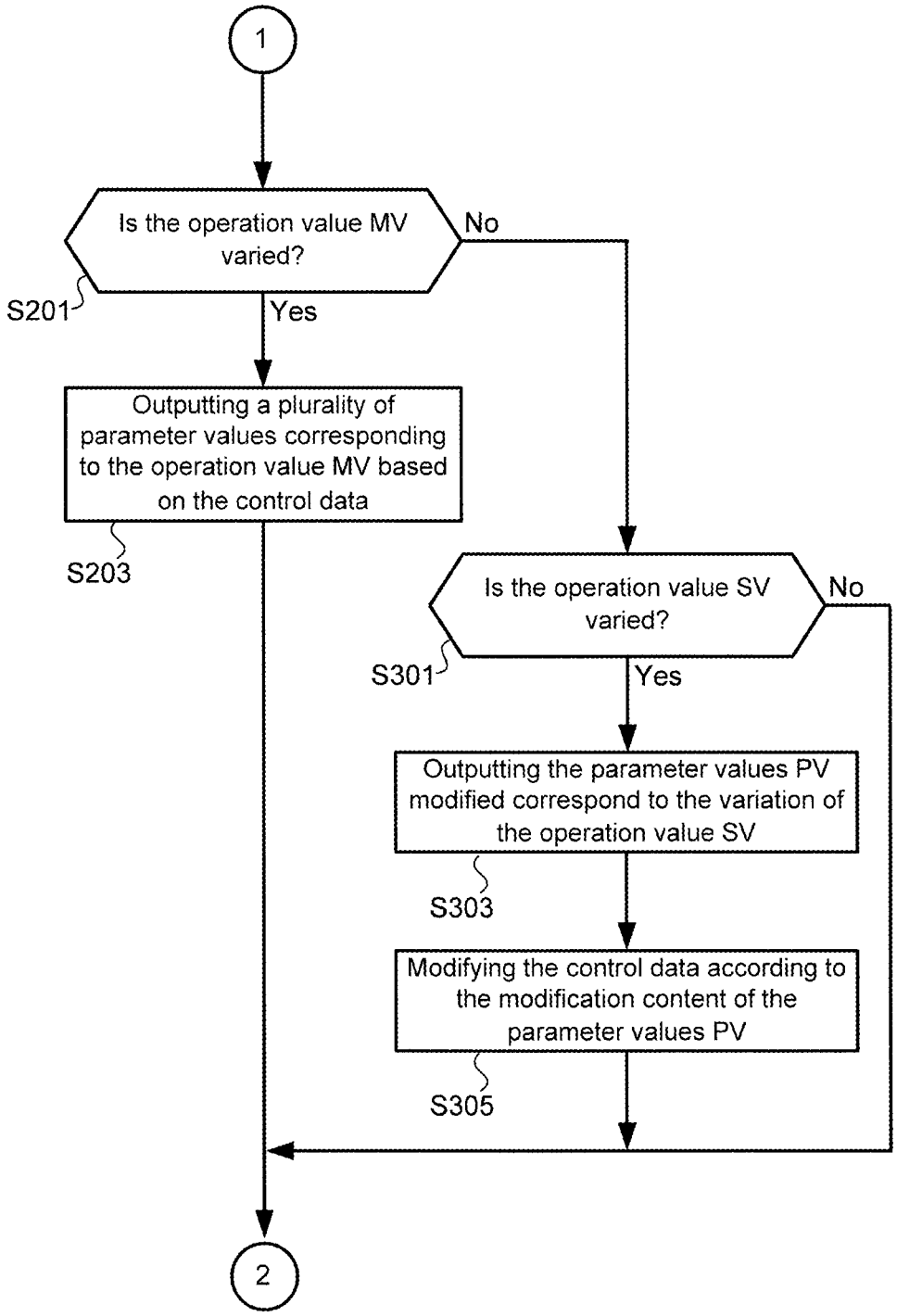
FIG. 8 is a flowchart illustrating a sound control method according to the first embodiment of the present disclosure.

FIGS. 7 and 8 are flowcharts for illustrating the sound control method according to the first embodiment of the present disclosure. When the mode is switched to the control mode for starting the sound control function 100, the flow is started. Switching to this control mode is performed, for example, when the control unit 10 acquires the operation signal Sm to determine the musical piece to be played back.

The control unit 10 performs initialization (step S100). The default settings include reading out the music data set and the setting data set of the musical piece to be played back, and registering the default settings to the operation value MV buffer 135. The first playback section of the musical piece is set as the initial value. As a result, the playback controlling unit 150 reads out the music data corresponding to the first playback section from the music data set, and the parameter output unit 140 reads out the setting data corresponding to the first playback section from the setting data set. The sound control method described here shows how to output the parameter value PVs in particular. Therefore, outputting the sound source control signal Ct by the above-described the playback controlling unit 150 is performed in parallel with the processing of the sound control method.

The control unit 10 performs a determination as to whether or not the playback section is selected (step S101), a determination as to whether or not the operation value MV is varied (step S201), and a determination as to whether or not the operation value SV is varied (step S301). The control unit 10 waits until any one of the selection of the playback section, the variation of the operation value MV, and the variation of the operation value SV occurs (step S101, No, step S201; No, step S301; No, step S501; No). This state is referred to as a standby state. When the playback section is selected by the section selecting unit 110 in the standby state (step S101, Yes), the control unit 10 (the playback controlling unit 150) reads out the music data of the selected playback section from the music data set (step S103). The control unit 10 (the parameter output unit 140) reads out the setting data of the selected playback section from the setting data set (step S105). The processing of the step S103 and the processing of the step S105 may be reversed in processing order.

Subsequently, the control unit 10 (the parameter output unit 140) acquires the operation value MV stored in the operation value MV buffer 135, and outputs a plurality of parameter values PV corresponding to the operation value MV based on the control data included in the setting data read out (step S107). At this time, the indicated position display units 55*a*, 55*b*, 55*c*, and 55*d* are displayed so as to indicate the operation values SaV, SbV, ScV, and SdV corresponding to a plurality of parameter values PV, respectively. In other words, the current operation values SaV, SbV, ScV, and SdV are updated corresponding to a plurality of parameter values PV associated with the variation of the operation values MV. The setting knob 20 may be automatically rotated so as to show the indicated positions indicating the operation values SaV, SbV, ScV, and SdV corresponding to the plurality of parameter values PV. Thereafter, the control unit 10 performs the process of the step S501.

When the operation value MV is varied in the standby state (step S201; Yes), that is, when the operation value MV acquisition unit 130 newly acquires the operation value MV, the control unit 10 (the parameter output unit 140) outputs a plurality of parameter values PV corresponding to the operation value MV based on the control data (step S203). This control data is the data included in the setting data last read out. Thereafter, the control unit 10 performs the process of the step S501.

When the operation value SV is varied in the standby state (step S301; Yes), that is, when the operation value SV acquisition unit 120 newly acquires the operation value SV, the control unit 10 (the parameter output unit 140) modifies the parameter values PV based on the control data so as to correspond to the variation amount of the operation value SV, and outputs the modified parameter values PV (step S303). This control data is the data included in the setting data last read out. In addition, the control unit 10 (the parameter output unit 140) also modifies the control data according to the modification content of the parameter values PV (step S305). Here, the conversion data CD in the control data are modified. Thereafter, the control unit 10 performs the process of the step S501.

How to modify the control data (the conversion data) in the step S305 will be described with reference to FIG. 9.

Figure 9:
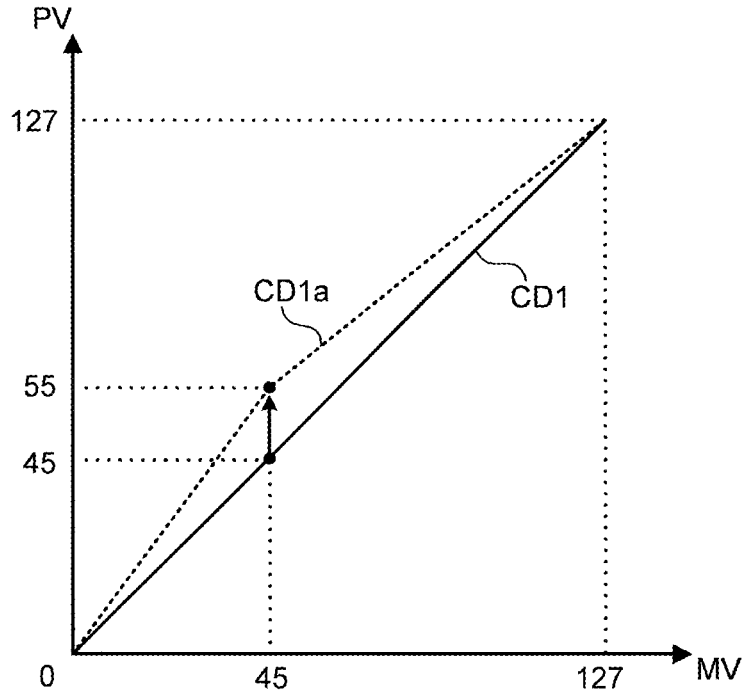
FIG. 9 is a diagram for illustrating a modification of the conversion data in the first embodiment of the present disclosure.

FIG. 9 is a diagram for illustrating a modification of the conversion data in the first embodiment of the present disclosure. In FIG. 9, an example of modifying the conversion data CD1 are shown. In this case, the obtained operation value MV is "45" and the output parameter value PV is "45", and the operation value SV is updated by a variation amount of "+10". By updating the operation value SV (as the operation value SaV in the example of FIG. 4), the parameter value PV is modified from the reference value "45" to the value "55 (=45+10)" corresponding to the variation amount of the operation value SV. As a result, the relationship between the operation value MV and the parameter value PV is corrected to the relationship that the parameter value PV is "55" when the operation value MV is "45".

In this example, the parameter values PV corresponding to the minimum value "0" and the maximum value "127" of the operation value MV is not updated as in the conversion data CD1*a* shown in FIG. 9. On the other hand, the parameter values PV corresponding to the operation values MV between the minimum value "0" and the value "45" to be updated and between the maximum value "127" and the value "45" to be updated are complementarily set. The example shown in FIG. 9 is supplemented by a linear function. More specifically, the increase rate (slope) of the parameter value PV with respect to the operation value MV is corrected from the conversion data CD1 to the conversion data CD1*a* so that the slope increases in the range from "0" to "45" of the operation value MV and decreases in the range from "45" to "127" of the operation value MV. Various known methods of complementation are applicable.

Such modification is performed on the entire conversion data associated with the varied operation value SV (in this example, the operation value SaV) in the conversion data included in the setting data corresponding to the target playback section. For example, in the control data corresponding to the other performance part, the conversion data associated with the operation value SaV becomes the modification target.

Returning to FIGS. 7 and 8, the description will be continued. When having received no instruction to terminate the control mode (S501; No), the control unit 10 returns to the above-described standby state. On the other hand, when having received an instruction to terminate the control mode (step S501; Yes), the control unit 10 terminates the process in the sound control function 100. The sound control method has been described above.

By supplying the sound source control signal Ct generated as described above to the sound source unit 40, the audio signal generated in the sound source unit 40 is varied in real time. At this time, the value of each of the parameters PM is individually varied by operating the setting knobs 20*a*, 20*b*, 20*c*, and 20*d*, and the values of the plurality of parameters PM are collectively varied by operating the master knob 30. In addition, the relationship between the operation of the master knob 30 and the variation of the parameter values PV is changed depending on the section of the musical piece. Therefore, when the playback section of the musical piece is changed, this relationship is also changed in real time.

Second Embodiment

The sound control function 100 has been realized by the control unit 10 in the electronic keyboard device 1 in the first embodiment, but may be realized by the control unit in other devices. For example, when the sound control function 100 is realized in a tablet terminal, at least the control unit 10 is included in the tablet terminal. At least some of the other components, such as the setting knob 20 and the master knob 30, may be implemented as external devices connected to the tablet terminal. The sound control function 100 may be realized in a device, such as a cloud server, which is connected to the network.

The sound control function 100 may be realized by cooperating a plurality of devices. For example, the functions of the section selecting unit 110 and the functions of the parameter output unit 140 may be realized in a first device, and the other functions may be realized in a second device. At this time, the first device and the second device need only be capable of transmitting and receiving various signals by wired or wireless communication. The sound control function 100 of the present disclosure need only include at least the functions realized by the first device in this example, namely, the functions of the section selecting unit 110 and the parameter output unit 140, and be capable of acquiring the required information from an external device.

The sound control function 100 may be realized in a device that does not have the keyboard unit 80, or may be realized in a device that does not have a performance operator.

<Modifications>

While an exemplary embodiment of the present disclosure has been described above, the exemplary embodiment of the present disclosure may be modified into various forms as follows. The exemplary embodiments described above and the modifications described below can be applied in combination with each other. Further, it is possible to add, delete, or replace another configuration with respect to a part of the configuration of each exemplary embodiment. In the following description, examples when modifying the first embodiment will be described, but may be applied to other embodiments.

(1) In the exemplary embodiment described above, the section selecting unit 110 selects playback section in response to a user's operation for the operation unit 70. The playback section may be selected in other manners. For example, an external device (e.g., a footswitch) connected to the interface 90 may be used to select the playback section.

(2) In the exemplary embodiment described above, the setting knob 20 and the master knob 30 are rotary encoders mounted on the housing 95. The structure that achieves the functionality of the setting knob 20 and the master knob 30 may have a form that differs from the knob. For example, the structures corresponding to the setting knob 20 and the master knob 30 may be a controller that can be used for outputting signals corresponding to the operation values MV and SV, may be a structure that accepts inputs by another operation method such as a slider, or may be an external device (e.g., a foot controller, a turntable, a touch panel, or the like) connected to the interface 90.

(3) In the exemplary embodiment described above, in the period from the timing when the selected playback section is switched to the timing when the operation value MV is newly acquired, the parameter output unit 140 reads out the operation value MV stored in the operation value MV buffer 135, and outputs a plurality of parameter values PV corresponding to the operation value MV using the setting data newly read out. Instead of using the operation value MV stored in the operation value MV buffer 135, the parameter output unit 140 may use a predetermined operation value MV (e.g., a default value). In this instance, the parameter output unit 140 may output a plurality of parameter values PV corresponding to the predetermined operation value MV by using the setting data newly read out in the period from the switching of the selected playback section to the acquisition of the new operation value MV.

(4) In the above-described exemplary embodiment, during the control of varying the plurality of parameter value PV by the operation for the master knob 30, the parameter value PV can be modified according to the operation for the setting knob 20. On the other hand, during the control by the operation of the master knob 30 is performed, the operation of the setting knob 20 may not be accepted. That is, the modification of the parameter value PV based on the operation of the setting knob 20 may not be performed.

(5) In the exemplary embodiment described above, the parameter values PV are used for varying sounds, but they may be used for varying a content other than sounds, for example, video. That is, the parameter values PV may be used to vary a content such as sounds and videos. Thus, the concept of the present disclosure includes the concept of a content control device. The sound control device for realizing the sound control function 100, such as the electronic keyboard device 1 described above, is only one example of the content control device. Similarly, the sound control function is one example of the content control function and sound control method is one example of content control methods.

What is claimed is:

1. A content control device for a content divided into multiple playback sections, the content control device comprising:

at least one memory storing executable instructions; and a processor that implements the executable instructions to execute a plurality of tasks, including:

a selecting task that selects a playback section among the multiple playback sections;

a first acquiring task that acquires a first operation value in response to an operation of a first operation unit;

an outputting task that outputs a plurality of parameter values, which are used for varying the content in the selected playback section, corresponding to the acquired first operation value based on control data that:

defines a relationship between the first operation value and each of the plurality of parameter values; and is associated respectively with each of the multiple playback sections; and a setting task that sets, in response to the selection of the playback section, the control data corresponding to the selected playback section.

2. The content control device according to claim 1, wherein:

the plurality of tasks include a storing task that stores the acquired first operation value in the at least one memory, and in a period from the selection of the playback section to acquiring a new first operation value, the outputting task outputs the plurality of parameter values corresponding to the stored first operation value based on the control data corresponding to the selected playback section.

3. The content control device according to claim 1, wherein, in a period from the selection of the playback section to acquiring a new first operation value, the outputting task outputs the plurality of parameter values corresponding to the acquired first operation value based on the control data corresponding to the selected playback section.

4. The content control device according to claim 1, wherein:

the first operation unit includes an operator for selecting the playback section, and the selecting task selects the playback section based on the operation of the operator.

5. The content control device according to claim 1, wherein the plurality of tasks include a playback control task that controls:

playing back the selected playback section by varying a content in the selected playback section according to the plurality of parameter values; and replaying of the content in the selected playback section from the beginning thereof to the end thereof after the playing of the selected playback section ends.

6. The content control device according to claim 1, wherein:

the plurality of tasks include a second acquiring task that acquires a second operation value in response to an operation of a second operation unit, the outputting task modifies at least one parameter value, among the plurality of parameter values, according to the second operation value, from a value corresponding to the first operation value.

7. The content control device according to claim 1, wherein:

the plurality of tasks include:

a second acquiring task that acquires a second operation value in response to an operation of a second operation unit; and an updating task that updates the control data, the outputting task modifies at least one parameter value, among the plurality of parameter values, according to the second operation value, from a value corresponding to the first operation value, and the updating task updates the control data based on the at least one parameter value modified according to the second operation value.

8. A method of controlling a content divided into multiple playback sections, the method comprising:

selecting a playback section among the multiple playback sections;

acquiring a first operation value in response to an operation of a first operation unit;

outputting a plurality of parameter values, which are used for varying the content in the selected playback section, corresponding to the acquired first operation value based on control data that:

defines a relationship between the first operation value and each of the plurality of parameter values; and is associated respectively with each of the multiple playback sections; and setting, in response to the selection of the playback section, the control data corresponding to the selected playback section.

9. The method according to claim 8, further comprising:

storing the acquired first operation value in a memory, wherein, in a period from the selection of the playback section to acquiring the new first operation value, the outputting of the plurality of parameter values outputs the plurality of parameter values corresponding to the stored first operation value based on the control data corresponding to the selected playback section.

10. The method according to claim 8, wherein, in a period from the selection of the playback section to acquiring a new first operation value, the outputting of the plurality of parameter values outputs the plurality of parameter values corresponding to the acquired first operation value based on the control data corresponding to the selected playback section.

11. The method according to claim 8, wherein:

the first operation unit includes an operator for selecting the playback section, and the selecting of the playback section selects the playback section based on the operation of the operator.

12. The method according to claim 8, further comprising:

playing back the selected playback section by varying a content in the selected playback section according to the plurality of parameter values; and replaying the content in the selected playback section from the beginning thereof to the end thereof after the playing of the selected playback section ends.

13. The method according to claim 8, further comprising:

acquiring a second operation value in response to an operation of a second operation unit, wherein the outputting of the plurality of parameter values includes modifying at least one parameter value, among the plurality of parameter values, according to the second operation value, from a value corresponding to the first operation value.

14. The method according to claim 8, further comprising:

acquiring a second operation value in response to an operation of a second operation unit; and updating the control data, wherein the outputting of the plurality of parameter values includes modifying at least one parameter value, among the plurality of parameter values, according to the second operation value, from a value corresponding to the first operation value, and wherein the updating of the control data updates the control data based on at least one parameter value modified corresponding to the second operation value.

15. A non-transitory computer-readable storage medium storing a program executable by a computer to execute a method of controlling a content divided into multiple playback sections, the method comprising:

selecting a playback section among the multiple playback sections;

acquiring a first operation value in response to an operation of a first operation unit;

outputting a plurality of parameter values, which are used for varying the content in the selected playback section, corresponding to the acquired first operation value based on control data that:

defines a relationship between the first operation value and each of the plurality of parameter values; and is associated respectively with each of the multiple playback sections; and setting, in response to the selection of the playback section, the control data corresponding to the selected playback section.

16. The non-transitory computer-readable storage medium according to claim 15, wherein:

the method further comprises storing the acquired first operation value in a memory, and in a period from the selection of the playback section to acquiring the new first operation value, the outputting of the plurality of parameter values outputs the plurality of parameter values corresponding to the stored first operation value based on the control data corresponding to the selected playback section.

17. The non-transitory computer-readable storage medium according to claim 15, wherein, in a period from the selection of the playback section of the content to acquiring a new first operation value, the outputting of the plurality of parameter values outputs the plurality of parameter values corresponding to the acquired first operation value based on the control data corresponding to the selected playback section.

18. The non-transitory computer-readable storage medium according to claim 15, wherein:

the first operation unit includes an operator for selecting the playback section, and the selecting of the playback section selected the playback section based on the operation of the operator.

19. The non-transitory computer-readable storage medium according to claim 15, wherein:

the method further comprises acquiring a second operation value in response to an operation of a second operation unit, and the outputting of the plurality of parameter values includes modifying at least one parameter value, among the plurality of parameter values, according to the second operation value, from a value corresponding to the first operation value.

20. The non-transitory computer-readable storage medium according to claim 15, wherein:

the method further comprises:

acquiring a second operation value in response to an operation of a second operation unit; and updating the control data, the outputting of the plurality of parameter values includes modifying at least one parameter value, among the plurality of parameter values, according to the second operation value, from a value corresponding to the first operation value, and the updating of the control data updates the control data based on at least one parameter value modified corresponding to the second operation value.

* * * * *